US009139990B2

(12) United States Patent
Bennage

(10) Patent No.: US 9,139,990 B2
(45) Date of Patent: Sep. 22, 2015

(54) FOOD WASTE DISPOSER AND MOUNTING FLANGE THEREFOR WITH MIS-INSTALLATION PREVENTION FEATURES

(75) Inventor: Walter Bennage, Pleasant Prairie, WI (US)

(73) Assignee: Emerson Electric Co., St. Louis, MO (US)

( * ) Notice: Subject to any disclaimer, the term of this patent is extended or adjusted under 35 U.S.C. 154(b) by 1024 days.

(21) Appl. No.: 13/251,332

(22) Filed: Oct. 3, 2011

(65) Prior Publication Data

US 2012/0256025 A1 Oct. 11, 2012

Related U.S. Application Data

(63) Continuation-in-part of application No. 13/079,224, filed on Apr. 4, 2011, now abandoned.

(60) Provisional application No. 61/325,414, filed on Apr. 19, 2010.

(51) Int. Cl.
*B02C 23/36* (2006.01)
*E03C 1/266* (2006.01)

(52) U.S. Cl.
CPC ..... *E03C 1/2665* (2013.01); *B02C 23/36* (2013.01)

(58) Field of Classification Search
CPC .... B02C 23/36; B02C 18/0092; E03C 1/2665
USPC ..... 241/46.015; 285/314, 359
See application file for complete search history.

(56) References Cited

U.S. PATENT DOCUMENTS

| | | | | |
|---|---|---|---|---|
| 3,025,007 | A | 3/1962 | Wieczorek | |
| 3,246,132 | A | 4/1966 | Jordan | |
| 3,684,199 | A * | 8/1972 | Bebinger | 241/46.015 |
| 3,797,764 | A | 3/1974 | Guth | |
| 3,827,730 | A | 8/1974 | Guth | |
| 6,142,460 | A | 11/2000 | Irwin | |
| 7,401,392 | B1 | 7/2008 | Ramsey | |
| 2002/0063178 | A1 | 5/2002 | Strutz et al. | |
| 2007/0170990 | A1 | 7/2007 | Park | |

OTHER PUBLICATIONS

Written Opinion of the International Searching Authority for International Application No. PCT/US2011/031375, mailed Jun. 29, 2011.

* cited by examiner

*Primary Examiner* — Mark Rosenbaum
(74) *Attorney, Agent, or Firm* — Harness, Dickey & Pierce, P.L.C.

(57) ABSTRACT

A mounting assembly for a food waste disposer includes a lower mounting flange having mounting tabs that engage with mounting ramps of an upper mounting flange. The lower mounting flange is rotated with its mounting tabs riding on the mounting ramps of the upper mounting flange to bring the upper and lower mounting flanges securely together. The lower mounting flange includes mis-installation prevention features that if all the mounting tabs of the lower mounting flange are not properly engaged with corresponding mounting ramps of the upper mounting flange, at least one of the mis-installation prevention features will interfere with one of the mounting ramps and prevent the lower mounting flange from being rotated.

19 Claims, 6 Drawing Sheets

FOOD WASTE DISPOSER AND MOUNTING FLANGE THEREFOR WITH MIS-INSTALLATION PREVENTION FEATURES

CROSS-REFERENCE TO RELATED APPLICATIONS

This application is a continuation-in-part of U.S. Ser. No. 13/079,224 filed Apr. 18, 2011. U.S. Ser. No. 13/079,224 claims the benefit of U.S. Provisional Application No. 61/325,414, filed on Apr. 19, 2010. The entire disclosures of the above applications are incorporated herein by reference.

FIELD

The present disclosure relates generally to food waste disposers, and more particularly, to a mounting assembly for food waste disposers that has a lower mounting flange with features preventing mis-installation.

Food waste disposers are used to comminute food scraps into particles small enough to safely pass through household drain plumbing. A conventional food waste disposer of the type for under sink mounting that is mounted to a sink, such as a kitchen sink, includes a food conveying section, a motor section, and a grinding section disposed between the food conveying section and the motor section. The food conveying section includes a housing that forms an inlet for receiving food waste and water. The food conveying section conveys the food waste to the grinding section, and the motor section includes a motor imparting rotational movement to a motor shaft to operate the grinding mechanism.

The grinding section in which comminution occurs typically has a rotating shredder plate with lugs and a stationary grind ring received in a housing of the grinding section. The motor turns the rotating shredder plate and the lugs force the food waste against the grind ring where it is broken down into small pieces. Once the particles are small enough to pass out of the grinding mechanism, they are flushed out into the household plumbing. Size control is primarily achieved through controlling the size of the gap through which the food particles must pass. In some cases, the housing of the grinding section and the housing of the food conveying section are integrally formed as a single housing. In other cases, they are not. Such a prior art food waste disposer is disclosed in U.S. Pat. No. 6,007,006, which is incorporated herein by reference in its entirety. The food waste disposer may be mounted in a well-known manner in the drain opening of a sink using mounting members of the type disclosed in U.S. Pat. No. 3,025,007, which is incorporated herein by reference in its entirety.

FIG. 1 depicts a prior art food waste disposer 100 (which is described in U.S. Pat. No. 6,854,673. U.S. Pat. No. 6,854,673 is incorporated by reference herein in its entirety. The disposer includes an upper food conveying section 102, a central grinding section 104 and a motor section 106, which may include a variable speed motor. It should be understood that motor section 106 could also include a fixed speed motor, such as an induction motor. The central grinding section 104 is disposed between the food conveying section 102 and the motor section 106.

The food conveying section 102 conveys the food waste to the central grinding section 104. The food conveying section 102 includes an inlet housing 108 and a conveying housing 110. The inlet housing 108 forms an inlet 109 at the upper end of the food waste disposer 100 for receiving food waste and water. The inlet housing 108 is attached to the conveying housing 110. A rubber o-ring 112 may be used between the inlet housing 108 and conveying housing 110 to prevent external leaks. A sealant bead may also be used instead of the rubber o-ring 112. The sealant bead is preferably composed of a tacky, malleable material that fills any voids between the inlet housing 108 and the conveying housing 110 and tempers any irregularities in the opposing surfaces of the housings. Some suitable malleable materials for the sealant bead include butyl sealant, silicone sealant, and epoxy.

The conveying housing 110 has an opening 114 to receive a dishwasher inlet 116. The dishwasher inlet 116 is used to pass water from a dishwasher (not shown). The inlet housing 108 and conveying housing 110 may be made of metal or injection-molded plastic. Alternatively, inlet housing 108 and conveying housing 110 may be one unitary piece.

The central grinding section 104 includes a grinding mechanism having a shredder plate assembly 118 and a stationary shredder ring 120. In one embodiment, the shredder plate assembly 118 may include an upper rotating plate 122 and a lower lug support plate 124. The upper rotating plate 122 and lower lug support plate 124 are mounted to a rotatable shaft 126 of a motor 180 of motor section 106, such as by a bolt 190. A portion of the conveying housing 110 encompasses the grinding mechanism. The grinding mechanism shown in FIG. 1 is a fixed lug grinding system. Alternatively, a moveable lug assembly could be used. The grinding mechanism could alternatively use an assembly with both fixed and moveable lugs.

The shredder ring 120, which includes a plurality of spaced teeth 128, is fixedly attached to an inner surface of the conveying housing 110 by an interference fit and is preferably composed of stainless steel but may be made of other metallic material such as galvanized steel. As shown in FIG. 1, ramps 129 formed on the inside wall of the housing 110 may also be used to retain the shredder ring 120 in the housing 110.

In the operation of the food waste disposer 100, the food waste delivered by the food conveying section 102 to the grinding section 104 is forced by lugs 142 on the shredder plate assembly 118 against teeth 128 of the shredder ring 120. Shredder plate assembly 118 may also include tumbling spikes 144. The sharp edges of the teeth 128 grind or comminute the food waste into particulate matter sufficiently small to pass from above the upper rotating plate 122 to below the plate via gaps between the teeth 128 outside the periphery of the plate 122. Due to gravity and water flow, the particulate matter that passes through the gaps between the teeth 128 drops onto a plastic liner 160 and, along with water entering into the disposer 100 via the inlet to the inlet housing 108, is discharged through a discharge outlet 162 into a tailpipe or drainpipe (not shown). To direct the mixture of particulate matter and water toward the discharge outlet 162, the plastic liner 160 is sloped downward toward the periphery side next to the discharge outlet 162. The discharge outlet 162 may be formed as part of a die-cast upper end bell 164. Alternatively, the discharge outlet 162 may be separately formed from plastic as part of the outer housing of the disposer.

An upper end bell 164 separates the central grinding section 104 and the motor section 106. The motor section 106 is housed inside a housing 174 and a lower end frame 176. The housing 174 may be formed from sheet metal and the lower end frame 176 may be formed from stamped metal. The housing 174 and lower end frame 176 are attached to the upper end bell 164 by screws or bolts 178.

The motor section 106 includes motor 180 having a stator 182 and a rotor 184. Stator 182 includes windings 186. The rotor imparts rotational movement to the rotatable shaft 126. The motor 180 is enclosed within the housing 174 extending between the upper and lower end frames 164 and 176. The motor 180 may be a variable speed motor and controlled by a controller 192. Alternatively, a brushless permanent magnet motor or controlled induction motor could be used.

The upper end bell 164, which may dissipate the heat generated by the motor 180, prevents particulate matter and water from contacting the motor 180, and directs the mixture of particulate matter and water to the discharge outlet 162.

The plastic liner 160 is attached to the die-cast upper end bell 164 by screws or bolts 166. The upper end bell 164 is attached to the conveying housing 110 by screws or bolts 168. To prevent external leaks, a ring bracket 170 and o-ring or sealer 172 may be used to secure the connection between the conveying housing 110 and the upper end bell 164.

With reference to FIG. 2, food waste disposers, such as food waste disposer 100, are generally installed to a sink in a two step procedure using a mounting assembly 200 of the type described in U.S. Pat. No. 3,025,007. First, a sink flange assembly 202, consisting of a sink flange 204, sink gasket 206, back-up flange 208, upper mounting flange 210, bolts 212, and retaining ring 214 are installed to the sink (not shown). Second, a disposer assembly consisting of a disposer such as disposer 100 (FIG. 1), a mounting gasket 216, and a lower mounting flange 218 are attached to the sink flange assembly. Lower mounting flange 218 is placed around inlet housing 108 of food conveying section 102 so that it is beneath inlet 109. Mounting gasket 216 is then placed around inlet 109. Inlet housing 108 of food conveying section 102 includes circumferential lip 188 extending around the circumference of inlet 109. Lip 188 is received in a corresponding recess (not shown) in mounting gasket 216 to secure mounting gasket 216 to food waste disposer at inlet 109. The attachment method, as described in patent U.S. Pat. No. 3,025,007, consists of engaging the mounting tabs 220 of the lower mounting flange 218 with the inclined mounting ramps 222 of the upper mounting flange 210 then rotating the lower mounting flange 218 until secure. The typical installation method involves raising the disposer 100 and mounting components to the sink flange assembly 202 with one hand then with the other hand lifting the lower mounting flange 218 and rotating to engage its mounting tabs 220 to the mounting ramps 222 of upper mounting flange 210. Rotating the lower mounting flange 218 brings it and upper mounting flange 210 securely together, compressing the mounting gasket 216 therebetween, and secures the disposer 100 to the sink flange assembly 202.

The installation of a food waste disposer, due to the weight of the disposer as well as the location and space constraints (below a sink in an enclosed sink cabinet), can be difficult and awkward. The ideal disposer installation would have the axis of the disposer and mounting components parallel and colinear to the axis of the sink flange assembly attached to the sink. In real practice, the disposer is usually held at some angle to the sink flange assembly and if the lower mounting flange is lifted up off the disposer and closer to the upper mounting flange in order to engage the ramps, then it is positioned at yet another angle. If the combination of angles is too great it is then possible to engage only two of the three mounting tabs 220 on the lower mounting flange 218, with the third mounting tab 220 being positioned below a corresponding mounting ramp 222 on the upper mounting flange 210. Engaging only two mounting tabs 220 as well as interference between the mounting gasket 216/upper mounting flange210/lower mounting flange 218/disposer 100 creates sufficient retention to minimally secure the disposer 100 to the sink flange assembly 202. The disengaged mounting tab 220 below the mounting ramp 222 is usually located toward the back of the sink cabinet where it is not easily seen and creates minimal compression on the mounting gasket 216 at that tab location. Under normal use, vibration from the disposer 100 and/or temperature variations cause by hot and cold water are sometimes sufficient to result in water leaking in the mounting gasket area of minimal compression within a relatively short period after installation.

SUMMARY

A mounting assembly for a food waste disposer in accordance with an aspect of the present disclosure includes a lower mounting flange having mounting tabs that engage with mounting ramps of an upper mounting flange. The lower mounting flange is rotated with its mounting tabs riding on the mounting ramps of the upper mounting flange to bring the upper and lower mounting flanges securely together. The lower mounting flange includes mis-installation prevention features that if all the mounting tabs of the lower mounting flange are not properly engaged with corresponding mounting ramps of the upper mounting flange, at least one of the mis-installation prevention features will interfere with one of the mounting ramps and prevent the lower mounting flange from being rotated.

In an aspect, the mis-installation prevention features include projections that extend radially inwardly from a circumferential wall of the lower mounting flange. In an aspect, the projections include V-shaped members extending radially inwardly from a circumferential wall of the lower mounting flange. In an aspect, the V-shaped members have opposed walls that angle toward each other as they extend radially inwardly from the circumferential. In an aspect, the V-shaped members are formed as stamped indentations in the circumferential wall of the lower mounting flange.

In an aspect, the mis-installation features include projections that extend upwardly from a bottom flange of the lower mounting flange. In an aspect, the projections are vertical members. In an aspect, the vertical members are screws or posts.

In an aspect, a food waste disposer includes a lower mounting flange with the mis-installation features.

BRIEF DESCRIPTION OF THE DRAWINGS

Other objects and advantages of the invention will become apparent upon reading the following detailed description and upon reference to the drawings in which.

Figure 1:
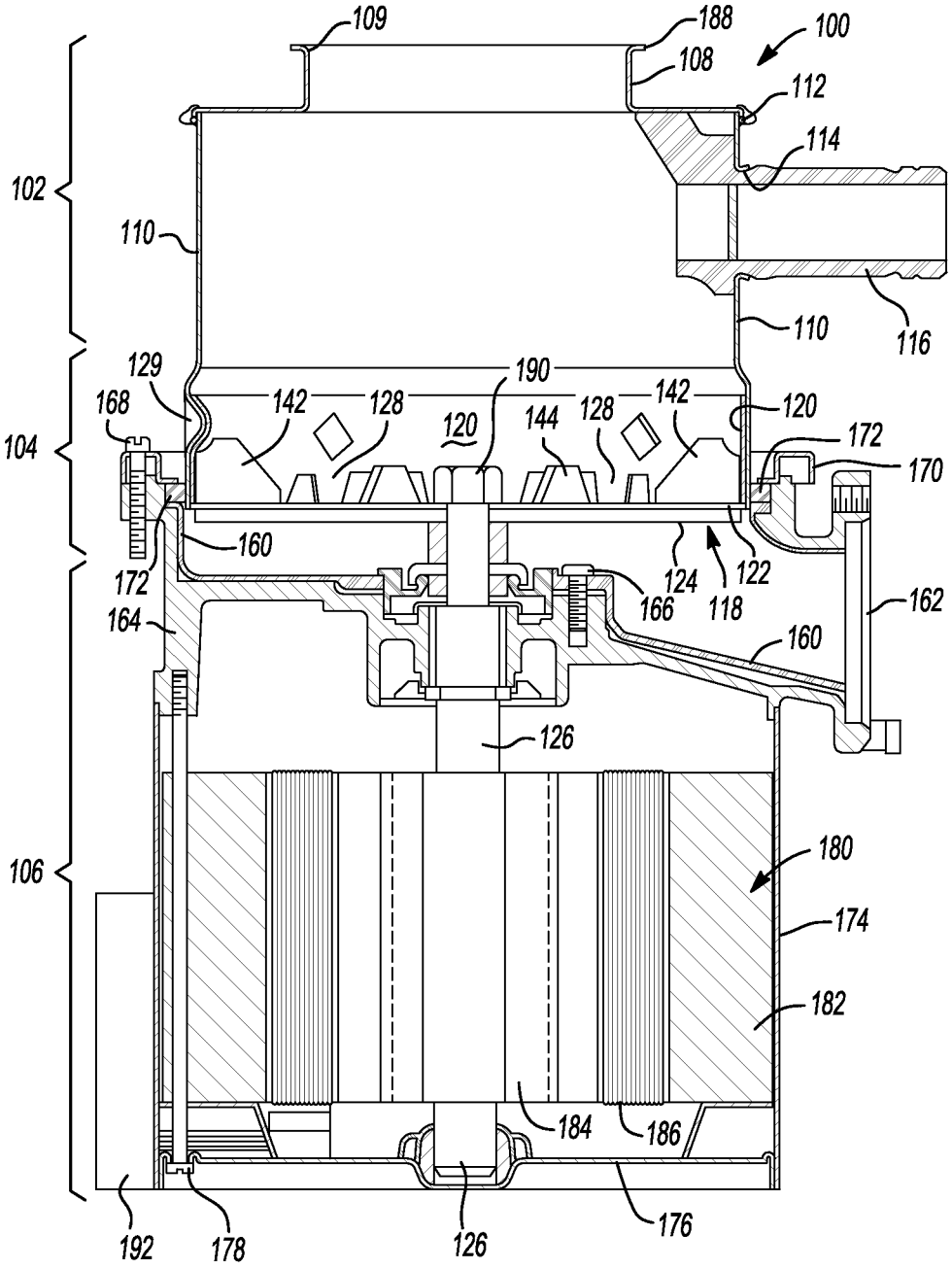
Fig-1 PRIOR ART
FIG. 1 is a sectional view of a prior art food waste disposer.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention.

DETAILED DESCRIPTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. It should be understood that throughout the drawings, corresponding reference numerals indicate like or corresponding parts and features.

Figure 2:
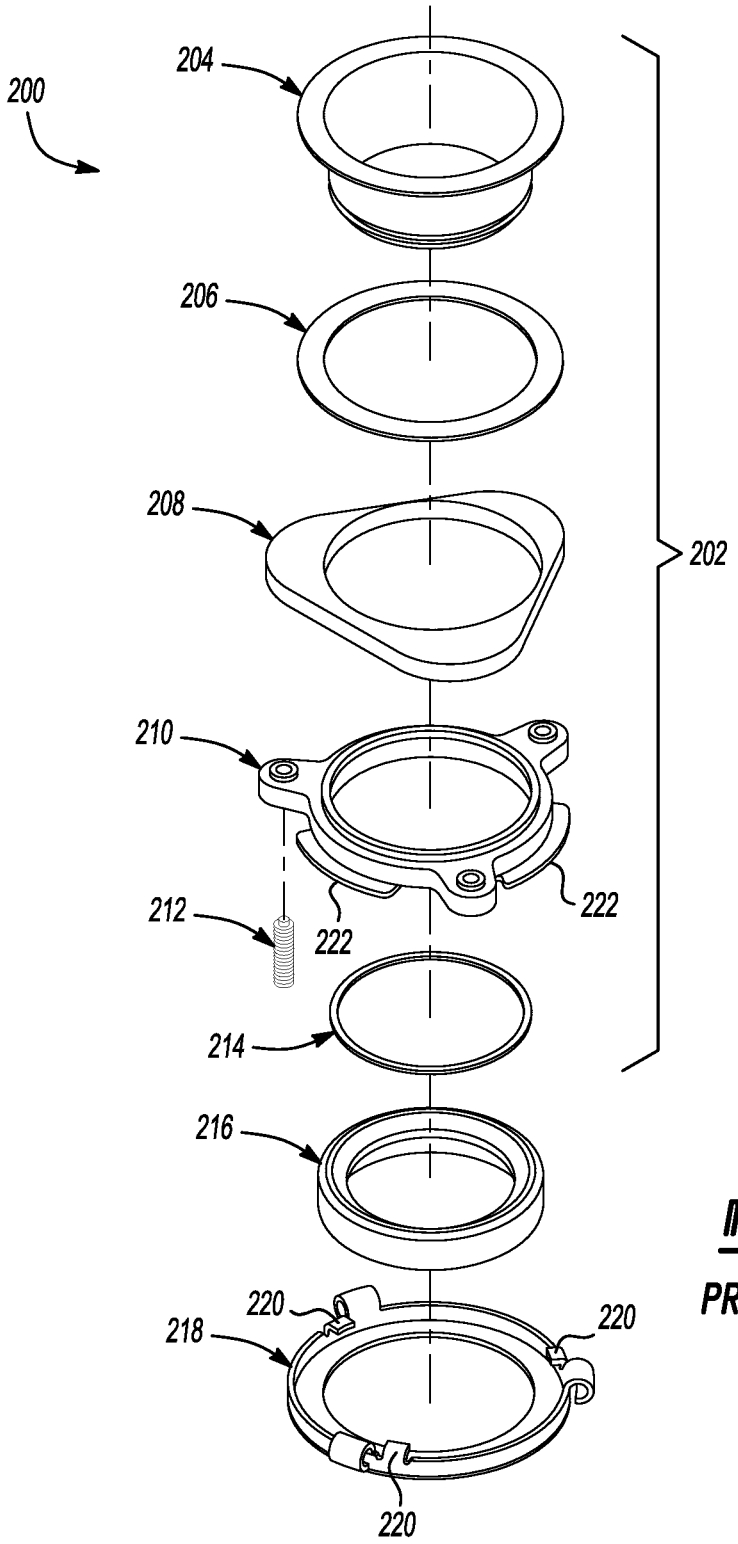
Fig-2 PRIOR ART
FIG. 2 is an exploded view of a prior art mounting assembly for mounting a food waste disposer to a sink.
Figure 3:
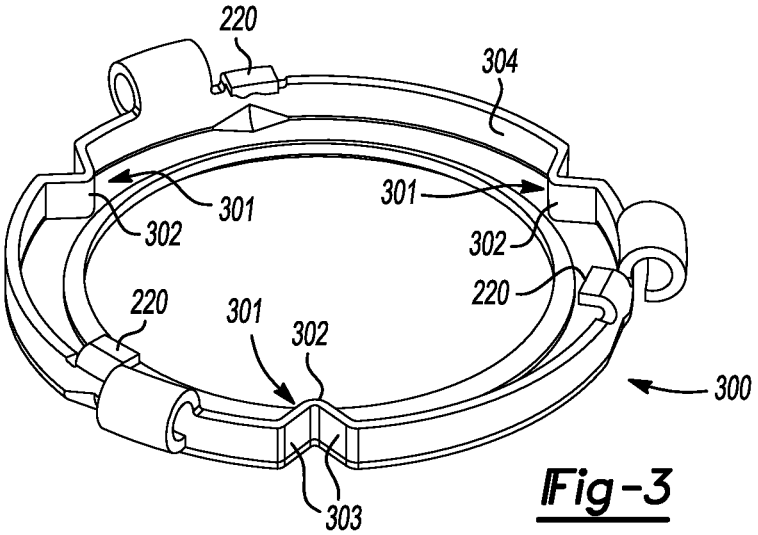
FIG. 3 is a perspective view of a lower mounting flange having mis-installation features in accordance with an aspect of the present disclosure.
Figure 6:
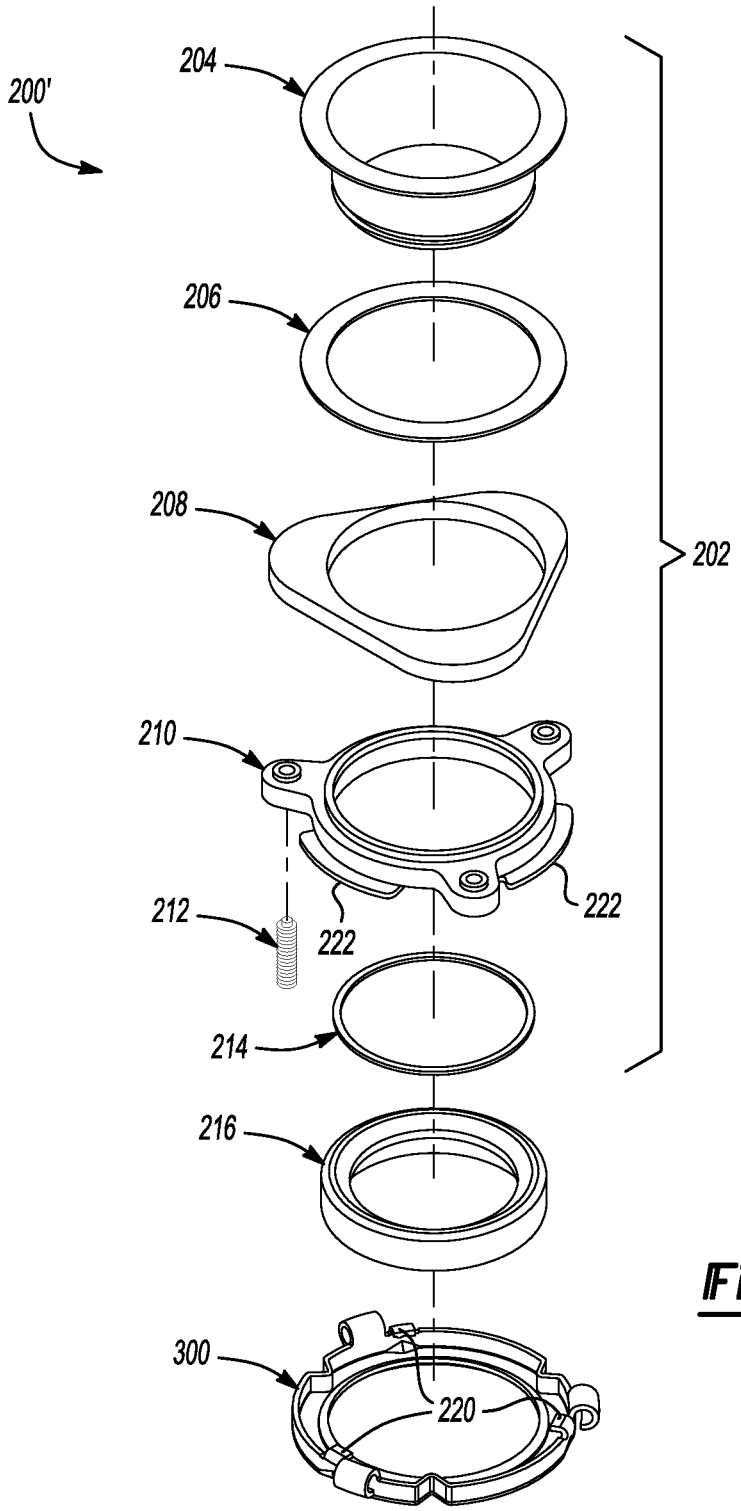
FIG. 6 shows a mounting assembly for mounting a food waste disposer to a sink having the lower mounting flange of FIG. 3.

With reference to FIGS. 3 and 6, a mounting assembly 200' in accordance with an aspect of the present invention is shown. Mounting assembly 200' is the same as mounting assembly 200 of FIG. 2 with the exception of lower mounting flange 300 and the following discussion is thus directed to lower mounting flange 300. With specific reference to FIG. 3, lower mounting flange 300 includes mis-installation prevention features that help prevent the above described mis-installation of a food waste disposer, such as food waste disposer 100. In an aspect, these mis-installation prevention features include projections 301 (FIG. 3) that extend radially inwardly from a circumferential wall 304 of lower mounting flange 300. In the embodiment shown in FIG. 3, projections 301 are V-shaped members 302 that project radially inwardly from the circumferential wall 304 of lower mounting flange 300. Lower mounting flange 300 illustratively includes a V-shaped member 302 for each mounting tab 220 with the V-shaped member 302 and the corresponding mounting tab 220 being located approximately 180 degrees from each other around the circumference of lower mounting flange 300. In an aspect, the each V-shaped member 302 has opposed walls 303 that angle toward each other as they extend radially inwardly from the circumferential wall 304. Each V-shaped member may illustratively be formed as a stamped indentation in circumferential wall 304.

V-shaped members 302 function such that if only two mounting tabs 220 are correctly engaged with mounting ramps 222 of upper mounting flange 210, then the V shaped member opposite the mis-installed mounting tab 220 will interfere with the mounting ramp 222 of upper mounting flange 210 immediately above the V-shaped member 302 and prevent the lower mounting flange 218 from rotating.

Figure 4A:
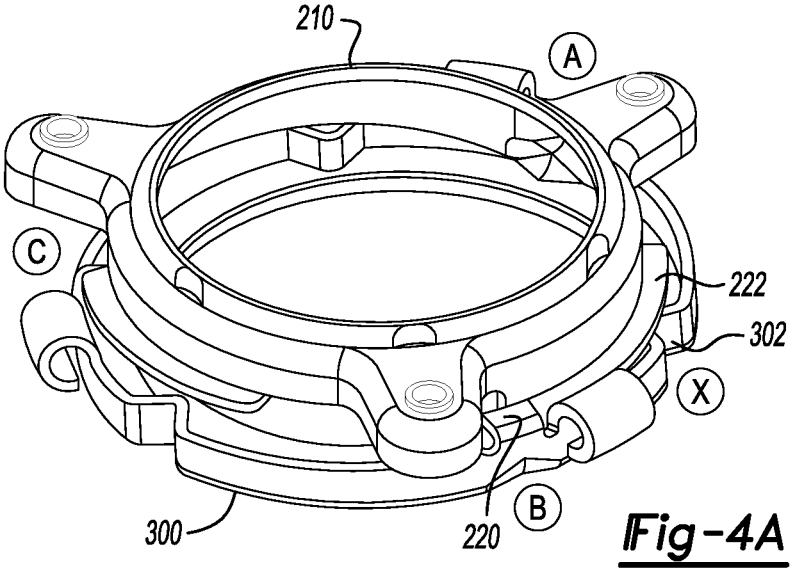
FIGS. 4*a* and 4*b* are perspective views showing how the mis-installation features of the lower mounting flange of FIG. 3 help prevent its mis-installation to an upper mounting flange of the mounting assembly of FIG. 2.
Figure 4B:
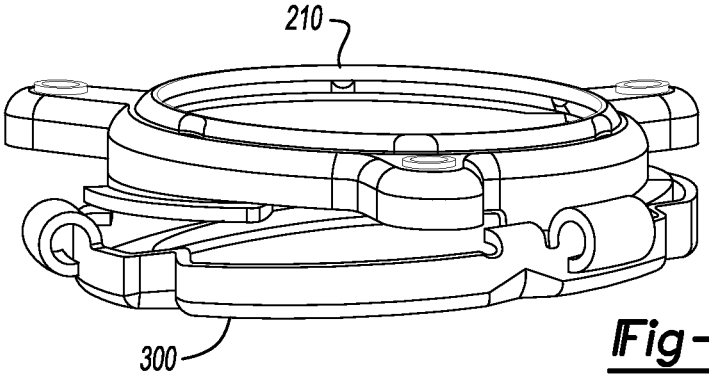

With reference to FIG. 4A, mounting tabs 220 of lower mounting flange 300 are correctly installed at locations "A" and "B" and mis-installed at location "C", and interference between the mounting ramp 222 of upper mounting flange 210 and the V shaped member 302 occurs at location "X." FIG. 4B shows the same parts as in FIG. 4*a* except at a different orientation. The net effect would be that lower mounting flange 300 can only be correctly installed by engaging all three of its mounting tabs 220 with the corresponding mounting ramps 222 of upper mounting flange 210.

Figure 5A:
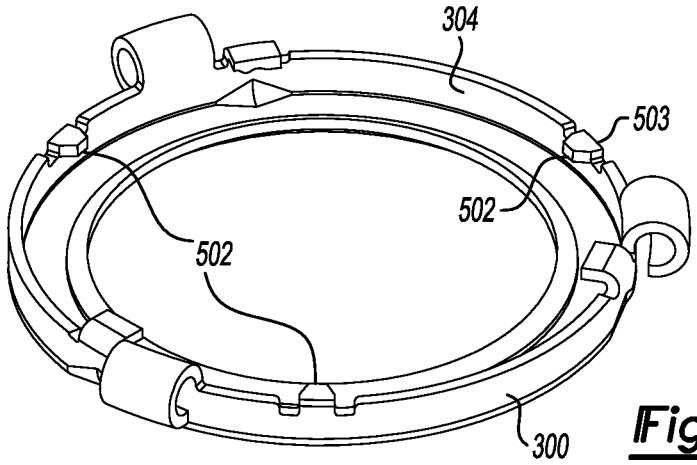
FIGS. 5A-5C show variations of the mis-installation features shown in FIG. 3.
Figure 5B:
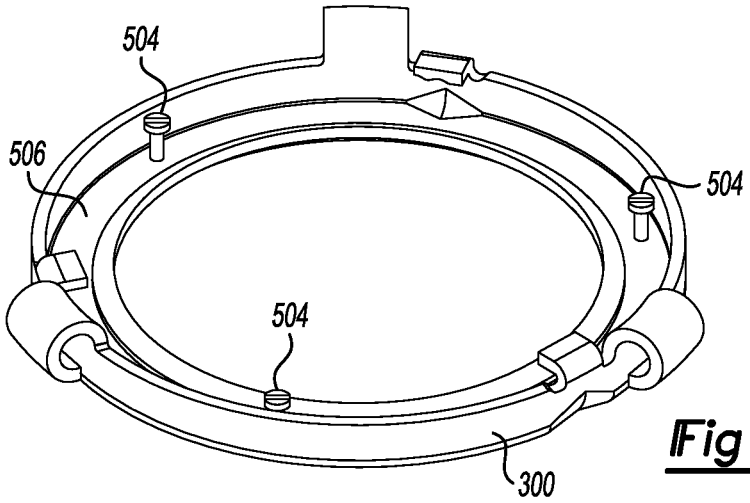
Figure 5C:
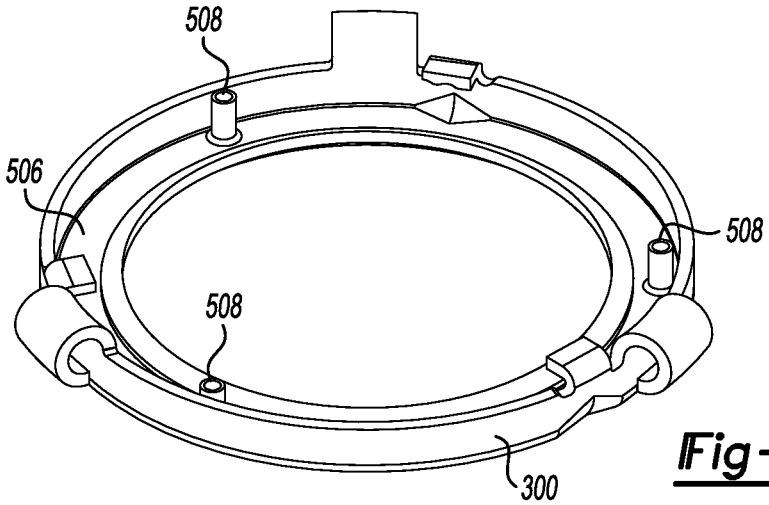

It should be understood that the mis-installation prevention features of lower mounting flange 300 can be other than V-shaped members. As shown in FIGS. 5*a*-5C, the projections 301 can be triangular or truncated triangular members 502 (FIG. 5A) that extend radially inwardly from a top edge 503 of circumferential wall 304 of lower mounting flange 300, or vertical members such as screws 504 (FIG. 5B) that extend upwardly from a bottom flange 506 of mounting flange 300, or posts 508 (FIG. 5C) that extend upwardly from bottom flange 506, or other shapes that provide the requisite interference with a mounting ramp of upper mounting flange 210 when lower mounting flange 218 is mis-installed.

Figure 7:
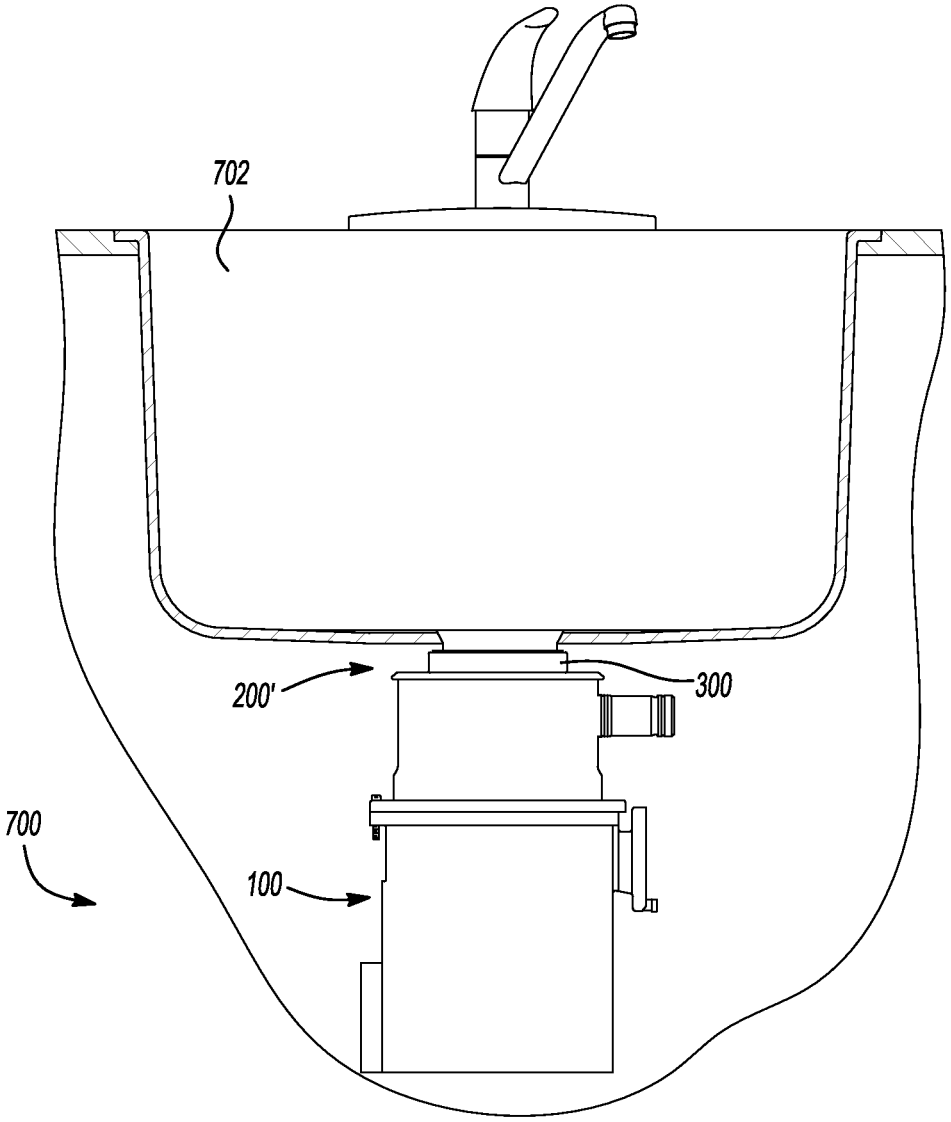
FIG. 7 shows a food waste disposer assembly mounted to a sink by the mounting assembly of FIG. 6.

FIG. 7 shows a food waste disposer assembly 700 having a food waste disposer, such as food waste disposer 100 of FIG. 1, installed to a sink 702 by mounting assembly 200'.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention.

What is claimed is:

1. A mounting assembly for a food waste disposer, comprising:

a lower mounting flange having mounting tabs that engage with corresponding inclined mounting ramps of an upper mounting flange; and the lower mounting flange including mis-installation prevention features wherein upon at least one of the mounting tabs properly engaged with a corresponding inclined mounting ramp of the upper mounting flange and at least one other of the mounting tabs not properly engaged with the corresponding inclined mounting ramp of the upper mounting flange, at least one of the mis-installation prevention features will interfere with an underside of one of the inclined mounting ramps and prevent the lower mounting flange from being rotated.

2. The mounting assembly of claim 1 wherein the mis-installation features include V-members extending radially inwardly from a circumferential wall of the lower mounting flange.

3. The mounting assembly of claim 2 wherein each V-shaped member has opposed walls that angle toward each other as they extend radially inwardly from the circumferential wall.

4. The mounting assembly of claim 1 wherein the mis-installation features include triangular or truncated triangular members extending radially inwardly from a top edge of a circumferential wall of the lower mounting flange.

5. The mounting assembly of claim 1 wherein the mis-installation features include vertical members that extend upwardly from a bottom flange of the lower mounting flange.

6. The mounting assembly of claim 5 wherein the vertical members are screws or posts.

7. The mounting assembly of claim 1 and further including a sink flange assembly that includes the upper mounting flange.

8. The mounting assembly of claim 7 and further including a mounting gasket received around an inlet of a food waste disposer.

9. The mounting assembly of claim 1 wherein the mis-installation features include projections extending radially inwardly from a circumferential wall of the lower mounting flange.

10. The mounting assembly of claim 1 wherein the mounting tabs project radially inwardly.

11. A food waste disposer assembly comprising:

a food waste disposer, including:

a food conveying section, a motor section and a grinding section , the grinding section disposed between the food conveying section and the motor section;

the grinding section including a grind mechanism, the grind mechanism including a stationary grind ring and a rotating shredder plate assembly that rotates within the stationary grind ring to grind food waste, the rotating shredder plate assembly rotated by a motor of the motor section;

the rotating shredder plate assembly includes a shredder plate and one or more lugs;

a mounting gasket received around an inlet of the food conveying section; and a lower mounting flange having mounting tabs that engage with corresponding inclined mounting ramps of an upper mounting flange, the lower mounting flange including mis-installation prevention features wherein upon at least one of the mounting tabs properly engaged with a corresponding inclined mounting ramp of the upper mounting flange and at least one other of the mounting tabs not properly engaged with the corresponding inclined mounting ramp of the upper mounting flange, at least one of the mis-installation prevention features will interfere with an underside of one of the inclined mounting ramps and prevent the lower mounting flange from being rotated.

12. The food waste disposer assembly of claim 11 wherein the mis-installation features include V-members extending radially inwardly from a circumferential wall of the lower mounting flange.

13. The food waste disposer of claim 12 wherein each V-shaped member has opposed walls that angle toward each other as they extend radially inwardly from the circumferential wall.

14. The food waste disposer assembly of claim 11 wherein the mis-installation features include triangular or truncated triangular members extending radially inwardly from a top edge of a circumferential wall of the lower mounting flange.

15. The food waste disposer assembly of claim 11 wherein the mis-installation features include vertical members that extend upwardly from a bottom flange of the lower mounting flange.

16. The food waste disposer assembly of claim 15 wherein the vertical members are screws or posts.

17. The food waste disposer assembly of claim 11, and further including a sink flange assembly having a sink flange with the upper mounting flange received by the sink flange.

18. The food waste disposer of claim 11 wherein the mis-installation features include projections extending radially inwardly from a circumferential wall of the lower mounting flange.

19. The food waste disposer assembly of claim 11 wherein the mounting tabs project radially inwardly.

* * * * *